US005156541A

United States Patent [19]

Lew

[11] Patent Number: 5,156,541

[45] Date of Patent: Oct. 20, 1992

[54] REVOLVING VANE PUMP-MOTOR-METER WITH A TOROIDAL WORKING CHAMBER

[76] Inventor: Hyok S. Lew, 7890 Oak St., Arvada, Colo. 80005

[21] Appl. No.: 696,586

[22] Filed: May 7, 1991

[51] Int. Cl.[5] ..... F04C 2/36; F01C 1/36

[52] U.S. Cl. ..... 418/226; 418/227; 418/233; 418/234; 123/243

[58] Field of Search ..... 418/225, 226, 233, 234, 418/227; 123/243

[56] References Cited

U.S. PATENT DOCUMENTS

| | | | |
|---|---|---|---|
| 1,279,912 | 9/1918 | Roberts | 418/227 |
| 2,341,710 | 2/1944 | Gingrich | 418/227 |
| 3,256,832 | 6/1966 | Hartley | 418/233 |
| 3,636,930 | 1/1972 | Okada | 418/233 |
| 3,895,893 | 7/1975 | Sommer | 418/226 |
| 4,082,485 | 4/1978 | Sommer | 418/226 |
| 4,646,568 | 3/1987 | Lew | 418/268 |

FOREIGN PATENT DOCUMENTS

| | | | |
|---|---|---|---|
| 643131 | 2/1931 | Australia | 418/226 |
| 2-125994 | 5/1990 | Japan | 418/233 |

*Primary Examiner*—Richard A. Bertsch
*Assistant Examiner*—David L. Cavanaugh

[57] ABSTRACT

A positive displacement pump-motor-meter has a housing structure and a rotor disposed within and supported by the housing structure in a rotatable arrangement about an axis of rotation, wherein the combination of the housing structure and the rotor provides a toroidal cavity encircling the axis of rotation and having cross sectional area varying from a maximum value at the 12 o'clock position to a minimum value at the 6 o'clock position, which toroidal cavity houses a plurality of planar vanes disposed therealong in an axisymmetric arrangement about the axis of rotation and supported by the rotor member in a revolvable arrangement about respective axes of revolution, of wherein the revolving motion of each of the plurality of vanes about its respective axis of revolution is coupled to the rotating motion of the rotor about the axis of rotation in such a way that the vane revolves at an angular speed equal to one half of the angular speed of the rotor, whereby each of the plurality of planar vanes substantially fills up cross section of the toroidal cavity at all instances throughout the rotating motion thereof about the axis of rotation and, consequently, moves fluid media through an inlet port and an outlet port respectively open to the two opposite halves of the toroidal cavity in a positive manner. The above-described positive displacement apparatus can be converted into an internal combustion engine when a fuel injecting device and a spark plug are added thereto.

17 Claims, 3 Drawing Sheets

REVOLVING VANE PUMP-MOTOR-METER WITH A TOROIDAL WORKING CHAMBER

BACKGROUND OF THE INVENTION

The positive displacement pump or motor or meter has very wide applications in industry as well as in the domestic area. Many existing versions of the positive displacement fluid handling devices have a small fluid occupied volume compared with the total bulk of the device and consequently, these versions are not suitable to handle fluid movements involving large flow rates. The present invention teaches a positive displacement pump-motor-meter that has a large fluid occupied volume constituting a major portion of the total bulk of the device, which can be constructed into an assembly wherein there is little sliding contact between moving parts and stationary parts included in the device and consequently, the teaching of the present invention provides a highly efficient and powerful positive displacement fluid handling device for pumping fluid or for harnessing power from the moving fluid or for measuring the rate of fluid flow.

BRIEF SUMMARY OF THE INVENTION

The primary object of the present invention is to provide a positive displacement pump-motor-meter comprising a plurality of substantially planar vanes mounted in an axisymmetric arrangement on a rotor member rotating about an axis of rotation, wherein each of the planar vanes is revolvably supported by the rotor member and geared to the rotating motion of the rotor member in such a way that each of the plurality of planar vanes revolves over 180 degrees for each 360 degree rotation of the combination of the rotor member and the plurality of planar vanes. The plurality of planar vanes travel through a toroidal cavity disposed about the axis of rotation, which toroidal cavity has cross sectional area varying from a maximum value at one cross section to a minimum value at the other cross section diametrically opposite to the cross section with the maximum cross sectional area in such a way that each of the plurality of planar vanes fills up the cross section of the toroidal cavity at all instances during the rotating motion thereof about the axis of rotation. The toroidal cavity has a wall with a portion of annular geometry provided by the rotary member, which portion of the wall supports the plurality of planar vanes, while the other remaining portion of the wall of the toroidal cavity is provided by a stationary housing structure that rotatably supports the combination of the rotor member and the plurality of planar vanes. An inlet port and an outlet port respectively open to the two opposite halves of the toroidal cavity are disposed on the two opposite sides of the plane including the cross sections of the toroidal cavity with the maximum and minimum cross sectional areas, respectively.

Another object is to provide the positive displacement pump-motor-meter described in the above-described primary object of the present invention, wherein the plurality of planar vanes are supported respectively by a plurality of stub shafts disposed axisymmetrically about the axis of rotation on a plane perpendicular to the axis of rotation and supported by the rotor member revolvably, and the inner and outer circumferential portions of the wall of the toroidal cavity substantially coincide with two concentric spherical surfaces with the common center located on the axis of rotation, respectively, wherein at least one of the inner and outer circumferential portions of the wall of the toroidal cavity is provided by the rotor member.

A further object of the present invention is to provide the positive displacement pump-motor-meter described in the primary object of the present invention, wherein the plurality of planar vanes are supported respectively by a plurality of stub shfts disposed axysymmetrically about the axis of rotation on a circular cylindrical surface coaxial to the axis of rotation and supported by the rotor member revolvably, and at least one of the two planar side walls of the toroidal cavity perpendicular to the axis of rotation is provided by the rotor member.

Yet another object is to provide the positive displacement pump-motor-meter described in the primary object of the present invention, wherein the plurality of planar vanes are supported respectively by a plurality of stub shafts disposed axisymmetrically about the axis of rotation on a conical surface coaxial to the axis of rotation and supported by the rotor member revolvably, and the inner and outer circumferential portions of the wall of the toroidal cavity substantially coincide with two concentric spherical surfaces with the common center located on the axis of rotation, respectively, which common center coincides with the point of convergence of the plurality of stub shafts, wherein at least one of the inner and outer circumferential portions of the all of the toroidal cavity is provided by the rotor member.

Yet a further object of the present invention is to provide an internal combustion engine employing the construction of the positive displacement pump-motor-meter described in the primary object of the present invention with a modified arrangement of the inlet and outlet ports, which are now disposed near the cross section of the toroidal cavity having the maximum cross sectional area, which construction now includes a fuel injection device and a spark plug disposed near the cross section of the toroidal cavity having the minimum cross sectional area.

These and other objects of the present invention will become clear as the description thereof progresses.

BRIEF DESCRIPTION OF THE FIGURES

The present invention may be described with a greater clarity and specificity by referring to the following figures.

DESCRIPTION OF THE ILLUSTRATED EMBODIMENTS

Figure 1:
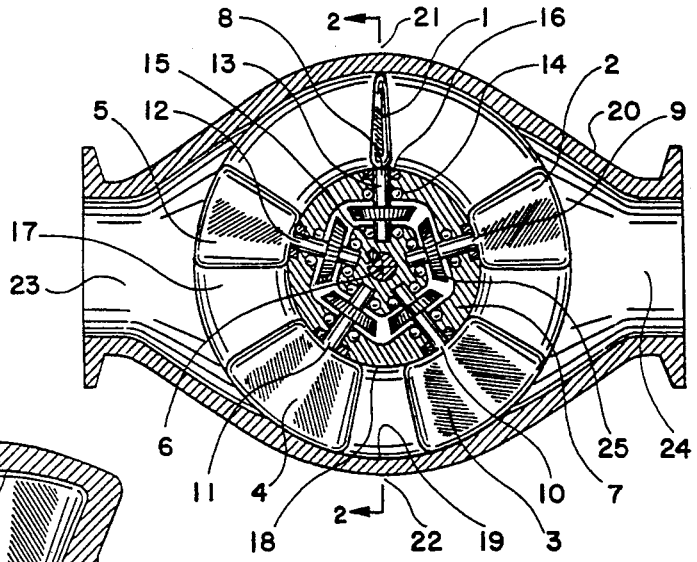
FIG. 1 illustrates a cross section of an embodiment of the revolving vane pump-motor-meter of the present invention.

In FIG. 1 there is illustrated a cross section of an embodiment of the revolving vane pump-motor-meter constructed in accordance with the principles of the present invention. This revolving vane apparatus comprises a plurality of substantially planar vanes 1, 2, 3, 4, 5, etc., disposed in a radially extending pattern from an axis of rotation 6 and revolvably supported by a rotor member 7 respectively about a plurality of axes of revolution 8, 9, 10, 11, 12, etc., disposed axisymmetrically about the axis of rotation 6 on a plane perpendicular to the axis of rotation 6, as each of the plurality of planar vanes is supported by a stub shaft or spindle 13 revolvably supported by a pair of bearings 14 and 15 secured to the rotor member 7, wherein a seal 16 preventing the fluid from leaking into the interior region in the rotor member 7 may be employed. The plurality of planar vanes 1, 2, 3, 4, 5, etc., travel through a toroidal cavity 17 disposed about the axis of rotation 6, wherein the inner circumferential portion 18 of the wall of the toroidal cavity 17 provided by the rotor member 7 substantially coincides with a spherical surface with the center lying on the axis of rotation 6, while the outer circumferential portion 19 of the wall of the toroidal cavity 17 provided by a stationary housing structure 20 substantially coincides with another spherical surface concentric to the spherical surface coinciding with the inner circumferential portion 18 of the toroidal cavity wall. The cross sectional area of the toroidal cavity 17 varies from the maximum value at the 12 o'clock position 21 to the minimum value at the 6 o'clock position 22 in such a way that each of the plurality of planar vanes 1, 2, 3, 4, 5, etc., traveling through the toroidal cavity 17 substantially fills up the cross section thereof at all instances during its orbiting motion about the axis of rotation 6 through the toroidal cavity 17. A pair of ports 23 and 24 are respectively open to the two opposite halves of the toroidal cavity 17 disposed on the two opposite sides of a plane including the cross sections 21 and 22 of the toroidal cavity 17 having the maximum and minimum cross sectional areas, respectively. Each of the plurality of planar vanes 1, 2, 3, 4, 5, etc., includes a bevel gear 25 that engages a nonrotating gear affixed to the housing structure 20 in a coaxial relationship to the axis of rotation 6 as shown in FIG. 2., which gear coupling makes each of the plurality of planar vanes to revolve 180 degrees about its axis of revolution for every 360 degree rotation thereof about the axis of rotation 6.

Figure 2:
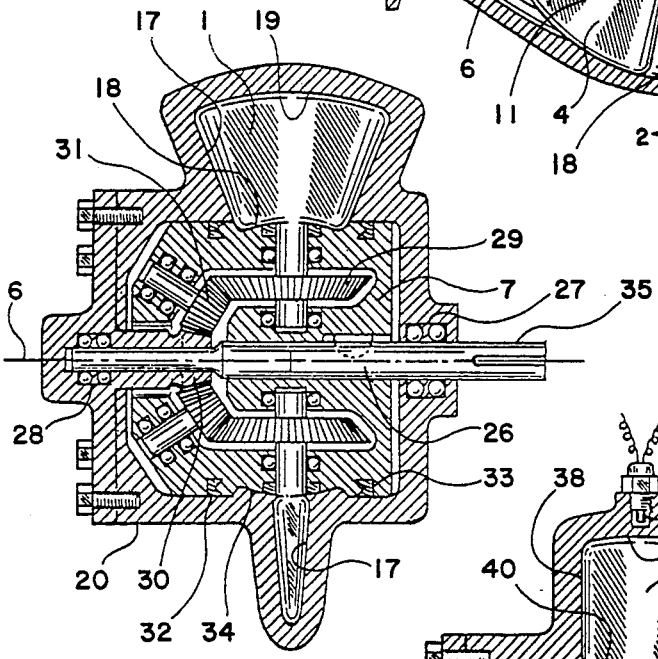
FIG. 2 illustrates another cross section of the embodiment shown in FIG. 1.

In FIG. 2 there is illustrated another cross section of the embodiment shown in FIG. 1, which cross section is taken along plane 2—2 as shown in FIG. 1. The rotor member 7 is nonrotatably mounted on a shaft 26 with the central axis coinciding with the axis of rotation 6, which shaft 26 is rotatably supported by the housing structure 20 by means of the bearings 27 and 28. Each of the plurality of bevel gears 29 respectively mounted on the plurality of stub shafts or spindles supporting the plurality of planar vanes 1, 2, 3, 4, 5, etc., engages a nonrotating bevel gear 30 affixed to the housing structure 20 in a coaxial relationship to the axis of rotation 6 through the idler gear 31. The pitch diameter of the bevel gear 29 is twice greater than the pitch diameter of the nonrotating bevel gear 30. It should be noticed that the shaft 26 extends through a clearance hole disposed through the nonrotating bevel gear 30 and is supported by the bearing 28. The ring seals 32 and 33 may be employed to confine the fluid medium within the toroidal cavity 17 and to prevent the fluid media from leaking into the interior region in the rotor member 7. The inner circumferential portion 18 of the wall of the toroidal cavity 17 is provided by the spherical portion 34 of surface of the rotary member 7, while the outer circumferential portion 19 coinciding with the second spherical surface and the two side portions of the wall of the toroidal cavity 17 is provided by the housing 20. The extremity 35 of the shaft 26 is used to transmit power to the rotor assembly including the planar vanes or to take out power therefrom when the apparatus is used as a pump or a motor. Of course, a device measuring the speed of rotation of the shaft 26 can be disposed at the extremity 35 as a measure of the volume flow rate of fluid media moving through the apparatus, when the apparatus is used as a flowmeter. It should be mentioned that the outer circumferential portion 19 of the wall of the toroidal cavity 17 may be provided by an annular cylindrical member with inner surface coinciding with the second spherical surface mentioned in conjunction with the description of FIG. 1, that is disposed in a rotatable arrangement within a shell of the housing structure including the two side walls of the toroidal cavity and rigidly coupled to the rotor member 7 by a plurality of tie-rods respectively disposed intermediate adjacent planar vanes and anchored to the inner and outer circumferential portions of the wall of the toroidal cavity 17. In such a revised construction, the port openings 23 and 24 open to the two opposite halves of the toroidal cavity 17 should straddle the annular cylindrical member or open through one or both side portions of the wall of the toroidal cavity 17, and each of the plurality of vanes may include a stub shaft or spindle extending from the outer circumferential edge of the planar vane in a coaxial relationship to the shaft or spindle extending from the inner circumferential edge thereof, wherein the stub shaft or spindle is now supported rotatably by the annular cylindrical member in a revolvable arrangement, which arrangement supports each of the plurality of planar vanes at the two circumferential extremities instead of the cantilever arrangement shown and described in FIGS. 1 and 2.

Figure 3:
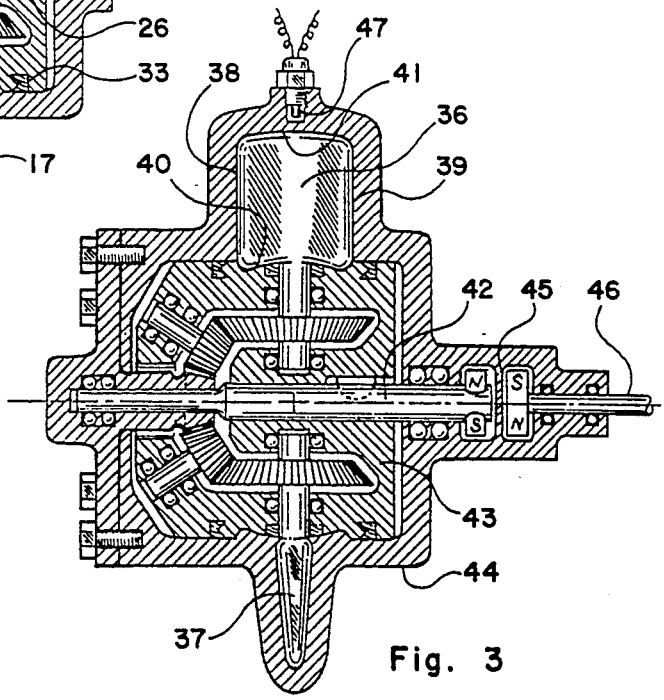
FIG. 3 illustrates a cross section of a modified version of the embodiment shown in FIG. 2.

In FIG. 3 there is illustrated a cross section of a revised version of the embodiment shown in FIGS. 1 and 2, which version includes essentially the same elements and the same construction as the embodiment shown in FIGS. 1 and 2 with one exception that is the planar configuration of the plurality of planar vanes. The plurality of planar vanes 36, 37, etc., included in the embodiment shown in FIG. 3 have two parallel side edges 38 and 39, while the plurality of planar vanes 1, 2, 3, 4, 5, etc., included in the embodiments shown in FIGS. 1 and 2 have two side edges respectively coinciding with two lines radiating from the common center of the two spherical surfaces including the inner and outer circumferential portions of the wall of the toroidal cavity 17. It should be understood that the two side edges of the planar vanes employed in the revolving vane pump-motor-meter of the present invention can have other geometries different from those shown in FIGS. 2 and 3. For example, the two side edges of the planar vanes may be tapered in an arrangement opposite to the shape of the two side edges of the planar vanes included in the embodiment shown in FIGS. 1 and 2. It is important that the inner and outer circumferential edges 40 and 41 of the planar vanes must have essentially the same radii of curvatures as the radii of curvatures of the spherical surfaces defining the inner and outer circumferential portion of the wall of the toroidal cavity accomodating the plurality of planar vanes. When the revolving vane apparatus of the present invention is used only as a flowmeter, the shaft 42 of the rotor assembly 43 may not extend through and out of the shell of the housing 44 as the speed of rotation of the rotor assembly 43 can be measured across a solid barrier by employing a motion sensor such as a magnetic transmission 45 transmitting the rotary motion of the shaft 42 to the shaft 46 coupled to a counter or rotary speed sensor, or a magnetic induction coil 47 detecting the passing of the individual planar vanes.

Figure 4:
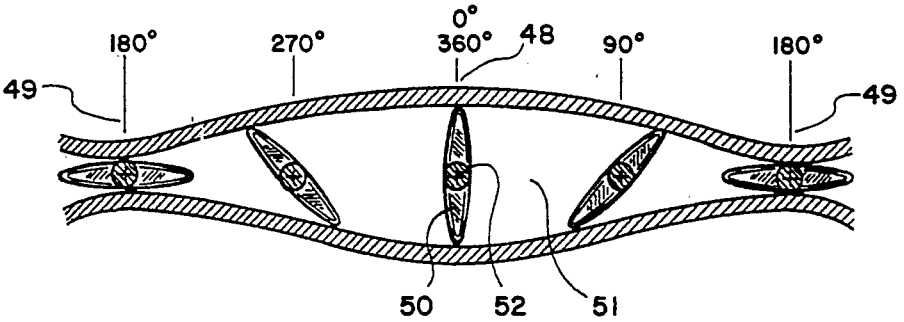
FIG. 4 illustrates a developed view of a cross section of the toroidal cavity including the plurality of planar vanes, which combination is included in the revolving vane pump-motor-meter shown in FIGS. 2 or 3.

In FIG. 4 there is illustrated a developed view of a cross section of the combination of the plurality of planar vanes and the toroidal cavity employed in the embodiment shown in FIG. 2 or 3, which cross section is taken along a cylindrical surface coaxial to the axis of rotation of the rotor assembly and disposed intermediate the inner and outer circumferential portions of the wall of the toroidal cavity. The angular position 48 designated by the angle of rotation of 0 and 360 degrees is equivalent to the 12 O'clock position 21 shown in FIG. 1, while the angular position 49 designated by the angle of rotation of 180 degrees corresponds to the 6 O'clock position 22 shown in FIG. 1. As the individual vane 50 travels through the toroidal cavity 51, it revolves about its axis of revolution 52 in such a way that the vane 50 plugs up the entire cross section of the toroidal cavity at all angular positions thereof with respect to the axis of rotation of the rotor assembly including the plurality of vanes. It should be noticed that the vane 50 is revolved to a position perpendicular to the direction of travel thereof at the 0 or 360 degree position 48, while it is rovolved to a position lining up with the direction of travel thereof at the 180 degree position 49. It is readily recognized that the vane revolves about its axis of revolution at a rotary speed equal to one half of the rotary speed of the rotating or orbiting motion thereof about the axis of rotation of the rotor assembly including the vane. The volume between two adjacent vanes progressively decreases in the region between 0 and 180 degrees and consequently, the fluid medium is expelled from the toroidal cavity 51 through the outlet port during this phase of rotary motion of the vane about the axis of rotation, while the volume between two adjacent vanes progressively increases in the region between 180 and 360 degrees and consequently, the fluid medium is pulled into the toroidal cavity 51 through the inlet port during this phase of rotary motion of the vane about the axis of rotation.

Figure 5:
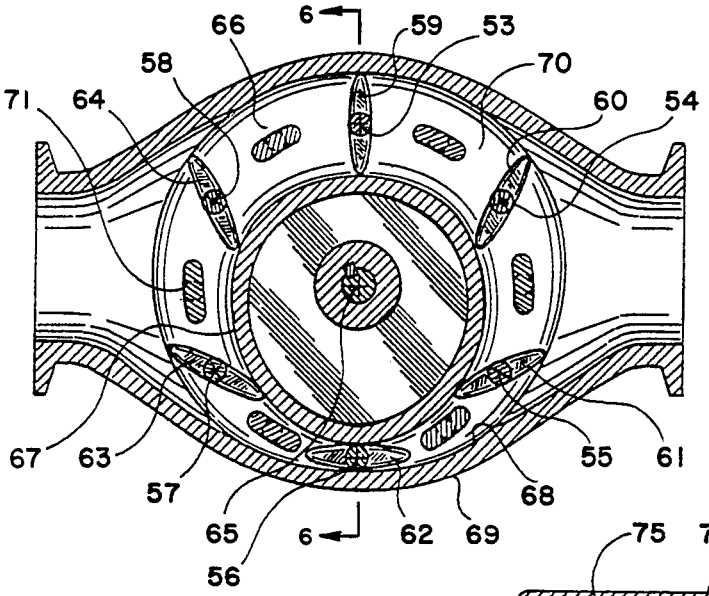
FIG. 5 illustrates a cross section of another embodiment of the revolving vane pump-motor-meter of the present invention.

In FIG. 5 there is illustrated a cross section of another embodiment of the revolving vane pump-motor-meter of the present invention, that operates on the same principles as those shown and described in conjunction with FIG. 4. This embodiment has elements and construction similar to those described in conjunction with FIGS. 1 and 2 with one exception, that is the axes of revolutions 53, 54, 55, 56, 57, 58, etc. of the planar vanes 59, 60, 61, 62, 63, 64, etc., which axes of revolutions are now disposed parallel to the axis of rotation in an axisymmetric arrangement about the same axis. The toroidal cavity 66 has a wall comprising the inner and outer circumferential portions 67 and 68 provided by the stationary housing structure 69, and the two side walls wherein one or both of the two side walls is provided by the rotor member 70 supporting the plurality of planar vanes 59, 60, 61, 62, 63, 64, etc., revolvably about the axes of revolutions 53, 54, 55, 56, 57, 58, etc. When both of the two side walls rotate with the rotor member 70, a plurality of tie-rods 71 respectively disposed intermediate two adjacent vanes and extending between the two end walls of the toroidal cavity 70 rigidly connect the end walls to one another.

Figure 6:
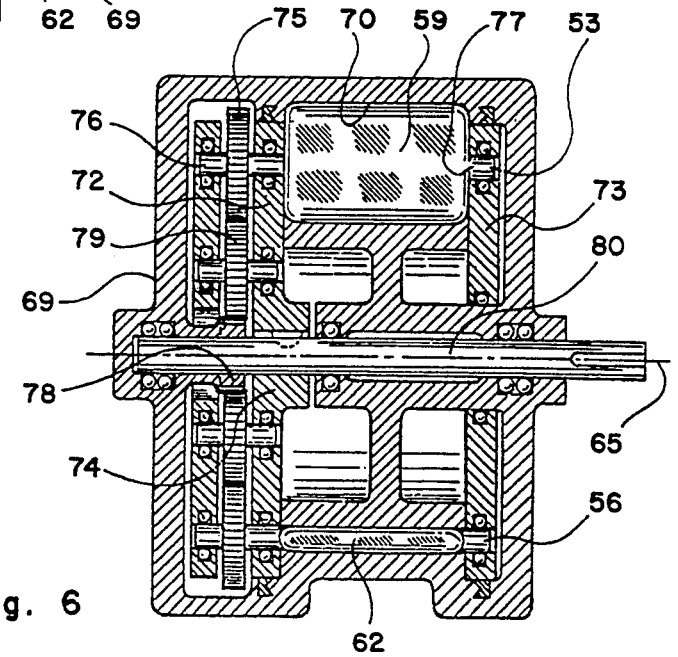
FIG. 6 illustrates another cross section of the embodiment shown in FIG. 5.

In FIG. 6 there is illustrated another cross section of the embodiment shown in FIG. 5, which cross section is taken along plane 6—6 as shown in FIG. 5. The two side walls 72 and 73 of the toroidal cavity 70 rotating with the rotor member 74 about the axis of rotation 65 revolvably supports the plurality of planar vanes 59, 60, 61, 62, 63, 64, etc. about the axes of revolutions 53, 54, 55, 56, 57, 58, etc. disposed parallel to and axisymmetrically about the axis of rotation 65. Each of the plurality of planar vanes includes a gear 75 nonrotatably mounted on one of the two stub shafts or spindles 76 and 77 supporting the planar vane, which gear 75 engages the nonrotating gear 78 disposed coaxially to the axis of rotation 65 and affixed to the housing structure 69 through the idler gear 79, wherein the pitch diameter of the gear 75 is twice greater than the pitch diameter of the nonrotating gear 78. The rotor assembly including the plurality of planar vanes 59, 60, 61, 62, 63, 64, etc., the end walls 72 and 73, and the rotor member 74 is nonrotatably mounted on the shaft 80 that is rotatably supported by the housing structure 69. It is readily recognized that the inner and outer circumferential portions of the toroidal cavity 70 are no longer needed to be spherical surfaces, while the two end walls 72 and 73 must be of two parallel planar surfaces. In a revised embodiment of the embodiment shown in FIG. 6, each of the plurality of vanes may be supported by a single stub shaft 76 in a cantilever arrangement, wherein the other stub shaft 77 and the plurality of tie-rods 71 shown in FIG. 5 can be omitted. Of course, the other end wall 73 should be a portion of the housing structure 69 in such a revised arrangement.

Figure 7:
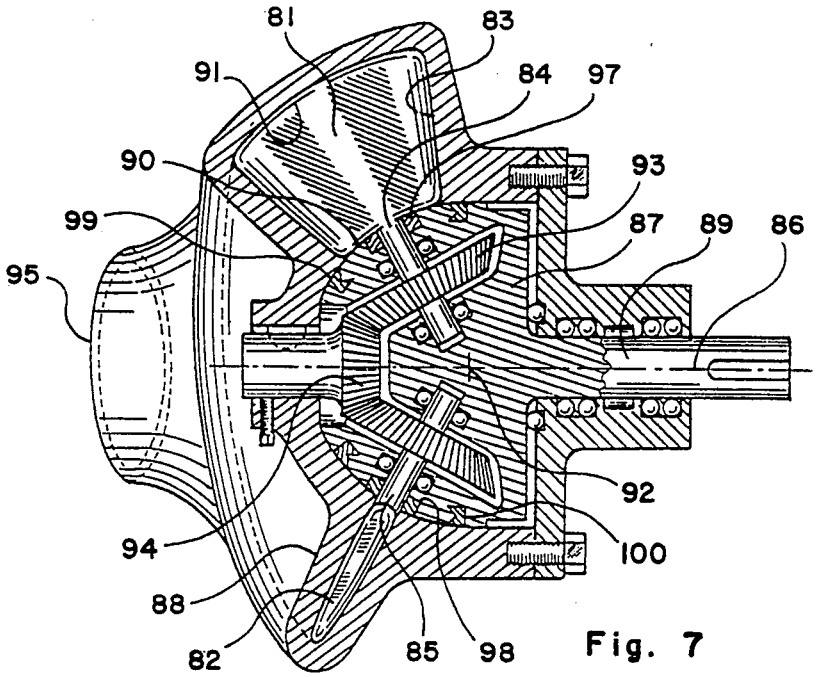
FIG. 7 illustrates a cross section of a further embodiment of the revolving vane pump-motor-meter of the present invention.

In FIG. 7 there is illustrated a cross section of a further embodiment of the revolving vane pump-motor-meter of the present invention, that operates on the same principles as those shown and described in conjunction with FIG. 4. This embodiment has a plurality of substantially planar vanes 81, 82, etc., disposed within the toroidal cavity 83 in a distributed arrangement, which planar vanes are respectively supported by a plurality of stub shafts or spindles 84, 85, etc., respectively disposed on a conic surface with the central axis coinciding with the axis of rotation 86 in an axisymmetric arrangement about the axis of rotation 86 and supported by the rotor member 87, which rotor member 87 is supported by the housing structure 88 rotatably about the axis of rotation 86 coinciding with the central axis of the shaft 89 extending from the rotor member 87. The inner circumferential portion 90 of the wall of the toroidal cavity 83 provided by the rotor member 87 and the outer circumferential portion 91 of the wall of the toroidal cavity 83 provided by the housing structure 88 respectively coincide with two concentric spherical surfaces having the center 92 located on the axis of rotation 86. Each of the plurality of planar vanes 81, 82, etc., includes a bevel gear 93 nonrotatably mounted on the respective stub shaft or spindle 84 and directly engaging a nonrotating bevel gear 94 disposed coaxially to the axis of rotation 86 and affixed to the housing structure 88, wherein the pitch diameter of the bevel gear 93 is twice greater than the pitch diameter of the bevel gear 94. This cross section view shows one of the two ports 95 open to one of the two opposite halves of the toroidal cavity 83. The seals 96, 97, 98, 99 and 100 are employed to confine the fluid media within the toroidal cavity 83 and prevent the fluid media from leaking into the interior region in the rotor member 87.

Figure 8:
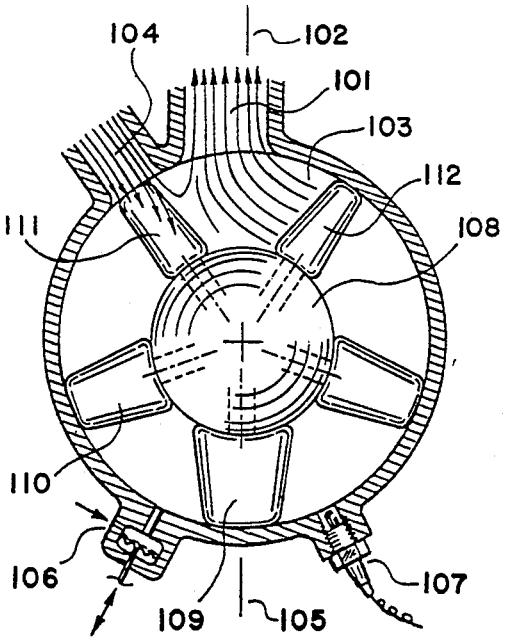
FIG. 8 illustrates a cross section of an embodiment of the internal combustion engine employing the construction of the revolving vane pump-motor-meter of the present invention with modified inlet and outlet ports.
Figure 9:
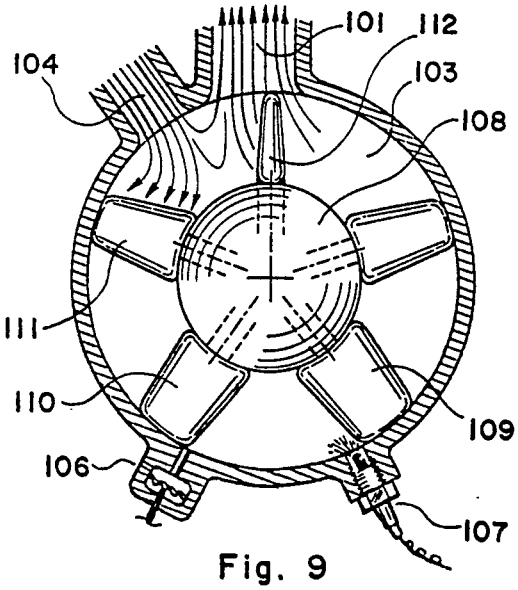
FIG. 9 illustrates the operating principles of the internal combustion engine shown in FIG. 8.

In FIGS. 8 and 9, there is illustrated a cross section of an embodiment of the internal combustion engine constructed in accordance with the principles employed in the construction of the revolving vane pump-motor-meter of the present invention, which figures also show operating principles of the internal combustion engine shown therein. This embodiment of the internal combustion engine has essentially the same elements and the same construction as those of of the revolving vane pump-motor-meter shown in FIGS. 2, 3, 6 or 7 with a few exceptions, which exceptions includes, firstly, the exhaust port 101 disposed near the cross section 102 of the toroidal cavity 103, where the cross sectional sectional area becomes the maximum, and secondly, the intake port 104 disposed near the exhaust port 101 on one side of the plane of symmetry including the cross sections of the maximum cross sectional area 102 and the minimum cross sectional area 105 of the toroidal cavity 103. A fuel injector 106 injecting fuel into the toroidal cavity in a scheduled timing is disposed near the cross section 105 where the cross sectional area of the toroidal cavity becomes the minimum on the same side of the plane of symmetry as that including the intake port 104. A spark plug 107 is disposed near the cross section 105 where the cross sectional area of the toroidal cavity becomes the minimum on the other side of the plane of symmetry opposite to the side including the fuel injector 106. The fuel injection is timed to the rotation of the rotor member 108 in such a way that the fuel injector 106 starts injecting fuel as soon as one of the plurality of planar vanes 109 passes the fuel injector 106 during the counter-clockwise rotation thereof in the particular illustrative embodiment shown in FIG. 8 and stops the fuel injection before the adjacent vane 110 following the vane 109 passes the fuel injector 106. The ignition by the spark plug 107 is timed to the rotation of the rotor member 108 in such a way that the fuel-air mixture contained between the two adjacent vanes 109 and 110 is ignited as soon as the vane 109 passes the spark plug 107. It should be noticed that the fresh air forced into the toroidal cavity 103 through the intake port 104 by a super-charger or turbo-charger purges out the burnt fuel-air mixture through the exhaust port 101 and charges the space between two adjacent vanes 111 and 112 with fresh air. The embodiment of the internal combustion engine shown in FIGS. 8 and 9 operates with or without the super-charger or turbo-charge forcing the air through the intake port 104. Of course, the revolving vane pump shown in FIG. 7, that is powered by the internal combustion engine shown in FIGS. 8 and 9 can be used as the super-charger forcing air flow through the intake port 104.

While the principles of the present invention have now been made clear by the illustrative embodiments, there will be many modifications of the structures, arrangements, proportions, elements and materials, which are obvious to those skilled in the art and particularly adapted to the specific working environments and operating conditions in the practice of the invention without departing from those principles. It is not desired to limit the invention to the illustrative embodiments shown and described and accordingly all suitable modifications and equivalents may be regarded as falling within the scope of the invention as defined by the claims which follow.

The embodiments of the invention, in which an exclusive property or priviledge is claimed, are defined as follows:

1. An apparatus for executing a function related to flow of fluid comprising in combination:

a) a housing;

b) a rotor member supported by the housing rotatably about an axis of rotation;

c) a toroidal cavity encircling the axis of rotation wherein at least a portion of wall of the toroidal cavity is provided by an annular surface encircling the axis of rotation and belonging to the rotor member, and the other portion of the wall of the toroidal cavity is provided by the housing, wherein the toroidal cavity has cross sectional area continuously varying from a maximum value at a first cross section substantially coinciding with a plane including the axis of rotation to a minimum value at a second cross section diametrically opposite to the first cross section across the axis of rotation and has cross sectional dimension between two opposing portions of the wall of the toroidal cavity provided by the housing varying from a maximum value at said first cross section to a minimum value at said second cross section, and further has two ports respectively open to two opposite halves of the toroidal cavity respectively located on two opposite sides of said plane;

d) a plurality of vanes with width greater than thickness thereof disposed within the toroidal cavity in a distributed arrangement about the axis of rotation and respectively supported by a plurality of stub shafts disposed following said at least a portion of the wall of the toroidal cavity provided by the rotor member in a substantially axisymmetric arrangement about the axis of rotation and revolvably supported by the rotor member; and e) a plurality of rotary members with positively meshing teeth elements disposed coaxially to respective central axes thereof, each of said plurality of rotary members nonrotatably mounted on each of the plurality of stub shafts supporting the vanes, wherein each of the plurality of rotary members positively engages a stationary round member with positively meshing teeth elements disposed coaxially to the axis of rotation and affixed to the housing in such a way that each of the plurality of vanes revolves about the central axis of each of the plurality of stub shafts supporting the vanes at one half of the angular speed of rotation of the rotor member about the axis of rotation;

wherein cross sectional area of the toroidal cavity is closely matched to areas of sweeps of the plurality of vanes throughout orbiting motions of the vanes about the axis of rotation in such a way that each of the plurality of vanes substantially fills up cross section of the toroidal cavity at all instances during orbiting motions of the vanes about the axis of rotation.

2. An apparatus as set forth in claim 1 wherein the rotor member includes a power shaft affixed to the rotor member coaxially to the axis of rotation and extending therefrom and through the housing.

3. An apparatus as set forth in claim 1 wherein said combination includes means for measuring speed of rotation of the rotor member about the axis of rotation as a measure of fluid media moving through the apparatus.

4. An apparatus as set forth in claim 1 wherein the plurality of stub shafts supporting the vanes are disposed on a plane perpendicular to the axis of rotation in a substantially axisymmetrically radiating pattern from the axis of rotation.

5. An apparatus as set forth in claim 4 wherein said at least a portion of the wall of the toroidal cavity provided by the rotor member includes an annular portion of a spherical surface with center located on said plane including the plurality of stub shafts and on the axis of rotation, wherein said annular portion of the spherical surface constitutes inner circumferential portion of the wall of the toroidal cavity.

6. An apparatus as set forth in claim 5 wherein outer circumferential portion of the wall of the toroidal cavity includes an annular portion of another spherical surface concentric to said a spherical surface.

7. An apparatus as set forth in claim 1 wherein the plurality of stub shafts supporting the vanes are disposed on a circular cylindrical surface coaxial to the axis of rotation in a parallel arrangement to the axis of rotation.

8. An apparatus as set forth in claim 7 wherein said at least a portion of the wall of the toroidal cavity provided by the rotor member includes a flat annular surface coaxial and perpendicular to the axis of rotation, wherein said flat annular surface constitutes one side portion of the wall of the toroidal cavity.

9. An apparatus as set forth in claim 8 wherein the other side portion of the wall of the toroidal cavity opposite to said one side portion of the wall of the toroidal cavity includes a flat annular surface coaxial and perpendicular to the axis of rotation.

10. An apparatus as set forth in claim 9 wherein said the other side portion of the wall of the totoidal cavity is also provided by the rotor member.

11. An internal combustion engine comprising in combination:

a) a housing;

b) a rotor member supported by the housing rotatably about an axis of rotation and including a power output shaft disposed coaxially to the axis of rotation;

c) a toroidal cavity encircling the axis of rotation wherein at least a portion of wall of the toroidal cavity is provided by an annular surface encircling the axis of rotation and belonging to the rotor member, and the other portion of the wall of the toroidal cavity is provided by the housing, wherein the toroidal cavity has cross sectional area continuously varying from a maximum value at a first cross section substantially coinciding with a plane including the axis of rotation to a minimum value at a second cross section diametrically opposite to the first cross section across the axis of rotation and has cross sectional dimension between two opposing portions of the wall of the toroidal cavity provided by the housing varying from a maximum value at said first cross section to a minimum value at said second cross section, and further has an exhaust port open to the toroidal cavity that is disposed near said first cross section, and an intake port open to the toroidal cavity that is disposed near the exhaust port in such a way that the vanes orbiting about the axis of rotation pass the exhaust port and the intake port in that order;

d) a plurality of vanes with width greater than thickness thereof disposed within the toroidal cavity in a distributed arrangement about the axis of rotation and respectively supported by a plurality of stub shafts disposed following said at least a portion of the wall of the toroidal cavity provided by the rotor member in a substantially axisymmetric arrangement about the axis of rotation and revolvably supported by the rotor member;

e) a plurality of rotary members with positively meshing teeth elements disposed coaxially to respective central axes thereof, each of said plurality of rotary members nonrotatably mounted on each of the plurality of stub shafts supporting the vanes, wherein each of the plurality of rotary members positively engages a stationary round member with positively meshing teeth elements disposed coaxially to the axis of rotation and affixed to the housing in such a way that each of the plurality of vanes revolves about the central axis of each of the plurality of stub shafts supporting the vanes at one half of the angular speed of rotation of the rotor member about the axis of rotation;

f) means for injecting fuel into the toroidal cavity disposed near said second cross section; and g) means for igniting fuel-air mixture contained in the toroidal cavity disposed near said means for injecting fuel in such a way that the vanes orbiting about the axis of rotation pass said means for injecting fuel and said means for igniting in that order;

wherein cross sectional area of the toroidal cavity is closely matched to areas of sweeps of the plurality of vanes throughout orbiting motions of the vanes about the axis of rotation in such a way that each of the plurality of vanes substantially fills up cross section of the toroidal cavity at all instances during orbiting motions of the vanes about the axis of rotation, and expanding volume of the combusting fuel-air mixture rotates the combination of the plurality of vanes and the rotor member about the axis of rotation.

12. An apparatus for executing a function related to flow of fluid media comprising in combination:

a) a housing;

b) a rotor member supported by the housing rotatably about an axis of rotation;

c) a toroidal cavity encircling the axis of rotation wherein at least a portion of wall of the toroidal cavity is provided by an annular surface encircling the axis of the rotation and belonging to the rotor member, and the other portion of the wall of the toroidal cavity is proided by the housing, wherein the toroidal cavity has cross sectional area varying continuously from a maximum value at a first cross section substantially coinciding with a plane including the axis of rotation to a minimum value at a second cross section diametrically opposite to the first cross section across the axis of the rotation, and has a first port open to first half of the toroidal cavity located on one side of a plane substantially including the maximum and minimum cross sections of the toroidal cavity and a second port open to a second half of the toroidal cavity located on the other side of said plane opposite to said one side;

d) a plurality of vanes with width greater than thickness thereof disposed within the toroidal cavity in a distributed arrangement about the axis of rotation and respectively supported by a plurality of stub shafts disposed following said at least a portion of the wall of the toroidal cavity provided by the rotor member on a conic surface coaxial to the axis of rotation in a substantially axisymmetric and converging arrangement towards an apex point located on the axis of rotation, and revolvably supported by the rotor member; and e) a plurality of positive rotary motion coupling means, wherein each of said plurality of positive rotary motion coupling means positively couples revolving motion of each of the plurality of vanes about the central axis of each of the plurality of stub shafts supporting the vane to rotating motion of the rotor member about the axis of rotation in such a way that the vane revolves about the central axis of the respective stub shaft at an angular speed equal to one half of the angular speed of the rotation of the rotor member about the axis of rotation;

wherein the variation of the cross sectional area of the toroidal cavity and the shape of the plurality of vanes are matched to one another in such a way that each of the plurality of vanes substantially fills up cross section of the toroidal cavity at all instances during orbiting movement thereof about the axis of rotation.

13. An apparatus as set forth in claim 12 wherein said at least a portion of the wall of the toroidal cavity provided by the rotor member includes an annular portion of a spherical surface concentric to said apex point defining the point of convergence of the plurality of stub shafts.

14. An apparatus as set forth in claim 13 wherein a portion of the wall of the toroidal cavity provided by the housing includes an annular portion of another spherical surface concentric to said a spherical surface.

15. An apparatus as set forth in claim 12 wherein the rotor member includes a power shaft affixed to the rotor member coaxially to the axis of rotation and extending therefrom and through the housing.

16. An apparatus as set forth in claim 12 wherein said combination includes means for masuring speed of rotation of the rotor member about the axis of rotation as a measure of fluid media moving through the apparatus.

17. An internal combustion engine comprising in combination:

a) a housing;

b) a rotor member supported by the housing rotatably about an axis of rotation and including a power output shaft disposed coaxially to the axis of rotation;

c) a toroidal cavity encircling the axis of rotation wherein at least a portion of wall of the toroidal cavity is provided by an annular surface encircling the axis of rotation and belonging to the rotor member and the other portion of the wall of the toroidal cavity is provided by the housing, wherein the toroidal cavity has cross sectional area varying continuously from a maximum value at a first cross section substantially coinciding with a plane including the axis of rotation to a minimum value at a second cross section diametrically opposite to the first cross section across the axis of rotation, and has an exhaust port open to the toroidal cavity that is disposed near said first cross section, and an intake port open to the toroidal cavity that is disposed near the exhaust port in such a way that the vanes orbiting about the axis of rotation pass the exhaust port and the intake port in that order;

d) a plurality of vanes with width greater than thickness thereof disposed within the toroidal cavity in a distributed arrangement about the axis of rotation and respectively supported by a plurality of stub shafts disposed following said at least a portion of the wall of the toroidal cavity proivded by the rotor member on a conic surface coaxial to the axis of rotation in a substantially axisymmetric and converging arrangement towards an apex point located on the axis of rotation, and revolvably suported by the rotor member;

e) a plurality of positive rotary motion coupling means, wherein each of said plurality of positive rotary motion coupling means positively couples revolving motion of each of the plurality of vanes about the central axis of each of the plurality of stub shafts supporting the vane to rotating motion of the rotor member about the axis of rotation in such a way that the vane revolves about the central axis of the respective stub shaft at an angular speed equal to one half of the angular speed of the rotation of the rotor member about the axis of rotation;

f) means for injecting fuel into the toroidal cavity disposed near said second cross section; and g) means for igniting fuel-air mixture contained in the toroidal cavity disposed near said means for injecting fuel in such a way that the vanes orbiting about the axis of rotation pass said means for injecting fuel and said means for igniting in that order;

wherein the variation of cross sectional area of the toroidal cavity and the shape of the plurality of vanes are matched to one another in such a way that each of the plurality of vanes substantially fills up cross section of the toroidal cavity at all instances during the orbiting movement thereof about the axis of rotation, and expanding volume of the combusting fuel-air mixture rotates the combination of the plurality of vanes and the rotor member about the axis of rotation.

* * * * *